United States Patent [19]

Mayer

[11] Patent Number: 5,060,880

[45] Date of Patent: Oct. 29, 1991

[54] APPARATUS FOR AUTOMATICALLY SPOOLING OUTPUT MEDIA FROM AN ELECTROGRAPHIC PRINTER

[75] Inventor: David M. Mayer, Fremont, Calif.

[73] Assignee: Xerox Corporation, Stamford, Conn.

[21] Appl. No.: 493,270

[22] Filed: Mar. 14, 1990

[51] Int. Cl.[5] ..... B65H 18/08; B65H 23/10; B65H 20/36

[52] U.S. Cl. ..... 242/75.2; 242/56 R; 242/67.1 R; 355/28; 83/279

[58] Field of Search ..... 242/75.2, 56 R, 67.1 R, 242/67.2, 67.3 R, DIG. 3, 67.4; 355/28, 29; 83/279, 481; 226/49, 108

[56] References Cited

U.S. PATENT DOCUMENTS

| | | | |
|---|---|---|---|
| 3,474,692 | 10/1969 | Sames | 355/29 X |
| 3,653,757 | 4/1972 | Newcomb | 355/28 X |
| 3,815,990 | 6/1974 | Newcomb et al. | 355/28 X |
| 4,569,584 | 2/1986 | St. John et al. | 355/208 X |
| 4,769,652 | 9/1988 | Cleary et al. | 242/67.3 R X |
| 4,784,345 | 11/1988 | Romanowski et al. | 242/67.2 X |
| 4,838,497 | 6/1989 | Kramer et al. | 242/67.2 |

*Primary Examiner*—Daniel P. Stodola
*Assistant Examiner*—John P. Darling
*Attorney, Agent, or Firm*—Serge Abend

[57] ABSTRACT

Apparatus for automatically spooling output media from a printer including a web supply of recording medium, a generally circular baffle arrangement for directing the recording medium into a tubular form, a drive roller for bidirectionally driving the recording medium into an out of the generally circular baffle arrangement, and means for applying a tensioning force on the recording medium between the baffle arrangement and the drive roller. The tensioning force is substantially the same whether the recording medium is being driven into or being driven out of the baffle arrangment and the surface speed of the recording medium is determined by the drive roller.

6 Claims, 4 Drawing Sheets

APPARATUS FOR AUTOMATICALLY SPOOLING OUTPUT MEDIA FROM AN ELECTROGRAPHIC PRINTER

FIELD OF THE INVENTION

The present invention relates to apparatus for automatically spooling output recording media from an electrographic printer into individual spools capable of being conveniently hand-held. More particularly, it relates to an apparatus into which recording medium is self threaded and which provides constant tension on the medium during unidirectional or bidirectional movement of the mediumthrough the printing apparatus.

BACKGROUND OF THE INVENTION

The electrographic recording process, for which the apparatus of this invention is particularly applicable, includes the steps of forming an electrostatic latent image upon a recording medium and subsequently making the latent image visible. The recording medium, usually provided in web form, has a dielectric surface and may be a coated paper, a polyester based transparent film, or other suitable material on which an electrostatic latent image is formed by means of a plurality of writing electrodes or stylii physically positioned on one side thereof to electrically address the dielectric surface as the medium travels therepast through a recording station. On the opposite side of the recording medium there are disposed a series of backup electrodes. When the potential difference between these recording elements is raised to a threshold level, on the order of several hundred volts, an electrostatic charge is deposited on the dielectric surface of the recording medium as the medium passes through the gap between the stylii and the backup electrodes.

Subsequently the latent image is made visible during the development step by applying liquid or dry toner to the recording medium. Normally such electrographic apparatus includes a liquid development system comprising a roller applicator movable through a bath of toner particles suspended in a carrier liquid, or a fountain over which a marking liquid flows. In each case, the recording medium is contacted by a thin film of developer material out of which the toner particles are electrostatically attracted to the regions of electrostatic charge on the medium.

Electrostatic plotters of this type have been commercially successful for many years in a monochrome mode, including a single recording station and a single development station dispensing a single color toner, usually black. More recently, electrostatic color plotters have been available to produce full color plots by the sequential overlaying of a series of separate color images (yellow, cyan, magenta and black) to produce a full spectrum of colors. It is clearly imperative that each color separation image must be in registration with the preceding images so as to prevent color fringes and color errors, and to provide high resolution color prints.

There are two basic approaches to color separation imaging. In one, a series of images are formed each by means of a dedicated recording head and development station. In the other, a single recording head forms each color separation image on the recording medium which is then advanced past one of the development stations. Then the recording medium is returned to the recording head for receiving the next color separation image and is advanced to the next development station. This process of advancing and returning the recording medium through the apparatus minimizes the number of recording heads and obviates the need for their critical alignment with respect to one another. On the other hand, it is very important that great care be taken during shuttling of the recording medium back and forth to insure that it does not mistrack or skew in the apparatus, resulting in color-to-color mismatch.

The web of recording medium, in each case, is dispensed from a supply roller to the image processing stations. In the single pass method, handling of the recording medium is greatly simplified as compared with the multiple pass method, since although a completed plot may be wound onto a take-up spool, it is also possible to feed it out of the machine with no provision for output storage, i.e. feeding onto the floor. This is not the case with the multiple pass method since the recording medium must be under positive control in two directions of movement before a completed plot may be achieved. As illustrated and described in U.S. Pat. No. 4,569,584 advancing and rewinding of the recording medium, in a multicolor electrographic plotter, is accomplished by feeding the medium from a supply roller to a take-up roller and by driving it with an intermediate main drive roller. The supply roller and the take-up roller each are continuously biased in opposite directions by individual drive motors so as to maintain the medium in a taut state of equilibrium which may be overcome by the drive motor applied to the main drive roller. Winding the completed plots onto a take-up spool, as taught in the '584 patent, is satisfactory for many applications but it requires that numerous completed plots be serially wound upon the take-up spool, prior to separating them into the individual plots and delivering them to their respective recipients.

One form of an output spooling station is shown and described in U.S. Pat. No. 4,784,345. In the single pass apparatus described therein, cut sheets of recording media are transported through a document reproduction apparatus and are delivered into a device for automatically rolling the sheets into tubular form. No provision is made for maintaining the medium taut as it is moved into the device.

Often it is desired to obtain an output plot of one's work shortly or immediately after it has been printed on a centralized plotter at a remote location. In such case it would be most convenient if the plotter apparatus had the capability to automatically provide individual plots from the supply web and to deliver them in rolled up, tubular form for ease of handling. It is an object of this invention to provide an automatic spooling apparatus having these features.

It is another object of this invention to provide an automatic shuttling spooling apparatus which will maintain the record medium taut in both directions of movement so as to prevent mistracking thereof.

Yet another object of this invention is to provide an automatic shuttling spooling apparatus which is self threading.

SUMMARY OF THE INVENTION

The present invention may be carried out, in one form, by providing apparatus for automatically spooling output media from a printer including a web supply of recording medium, a generally circular baffle arangement for directing the recording medium into a tubular form, a drive roller for bidirectionally driving the recording medium into and out of the generally circular baffle arangement, and means for applying a tensioning force on the recording medium between the baffle arangement and the drive roller, the tensioning force being substantially the same whether the recording medium is being driven into or being driven out of the baffle arangement.

BRIEF DESCRIPTION OF THE DRAWINGS

Other objects and further features and advantages of this invention will be apparent from the following, more particular, description considered together with the accompanying drawings, wherein.

DETAILED DESCRIPTION OF THE ILLUSTRATED EMBODIMENTS

Figure 1:
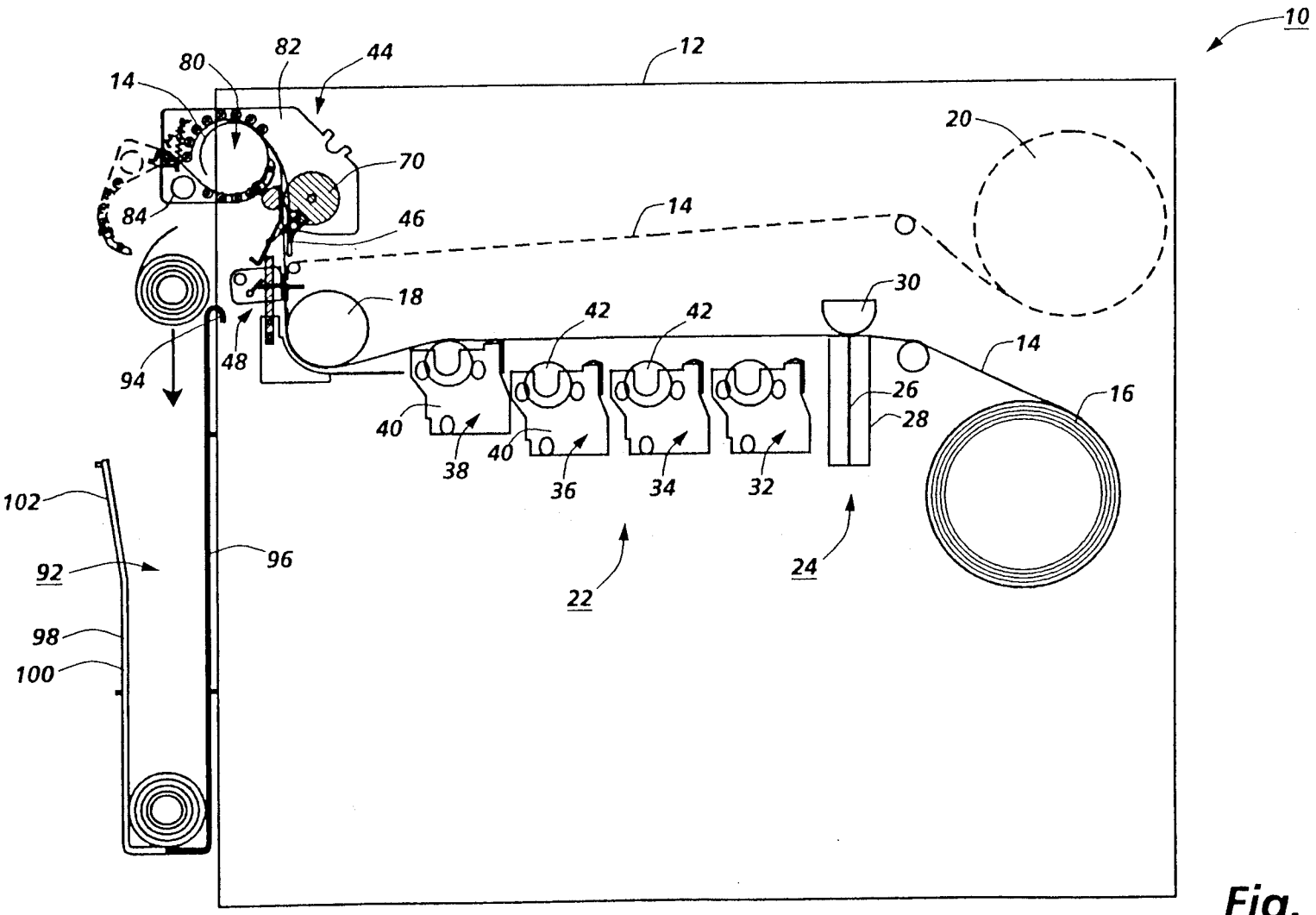
FIG. 1 is a schematic side elevation view showing the recording medium transport elements in an electrographic plotter including the spooling apparatus of the present invention.

Turning now to FIG. 1 there is shown a multi-color electrostatic plotter 10 including a housing 12 within which information is recorded upon a recording medium 14 dispensed from a supply roller 16 and driven past processing stations by means of drive roller 18, driven by a drive motor (not shown). In conventional operation, as illustrated in phantom lines, the recording medium is threaded around and is stored upon a take-up roller 20. The recording medium 14 is driven past a recording zone 22 at which images are formed thereupon.

At recording zone 22 there is a recording head 24 having one or more aligned (into the plane of the drawing) rows of writing stylus electrodes 26 mounted in a dielectric support body 28. On the opposite side of the recording medium 14 is a similarly aligned row of back-up electrodes 30. Suitable electrical connections couple the stylus electrodes 22 and back-up electrodes 26 to their respective drive electronics for selectively firing individual stylus electrode elements for forming latent electrostatic charge patterns on the recording medium.

The recording zone 22 further includes a plurality of liquid development fountains 32, 34, 36 and 38. Each of the fountains 32–38 comprises a liquid toner container 40 within which is a partially submerged roller 42. As liquid toner is pumped up to contact the recording medium, toner particles are attracted out of the liquid and adhere to the charge pattern. The roller 42 is rotated in the direction opposite to the direction of media movement and wipes off excess toner. Each fountain, containing and dispensing a single color toner, is sequentially raised to contact the recording medium. For example, fountain 32 may contain black liquid toner, fountain 34 may contain magenta liquid toner, fountain 36 may contain cyan liquid toner and fountain 38 may contain yellow liquid toner.

As illustrated, the recording medium is not to be collected upon the take-up roller in the conventional manner, but rather it is unanchored and is delivered into a spooling apparatus 44. To this end, a series of deflector fingers 46 are in a position to allow the recording medium to pass to the spooling apparatus, rather than in the position illustrated in phantom lines.

The spooling apparatus 44 of the present invention is mounted atop the plotter 10 directly above the drive roller 18 as illustrated in FIG. 1. Its details of construction may best be seen in the enlarged view of FIG. 2. Between the spooling apparatus and the drive roller there is located a cutter assembly 48 comprising a body 50 within which is supported a rotatable cutter wheel 52. A guide rod 54, secured in the housing, passes through the body and supports it for traversing movement back and forth across the housing when it is pulled by a drive cable 56 suitably connected to a cutter motor (not shown). As the cutter wheel is thus driven, it cooperates with a fixed anvil 58 for severing the recording medium therebetween.

Figure 2:
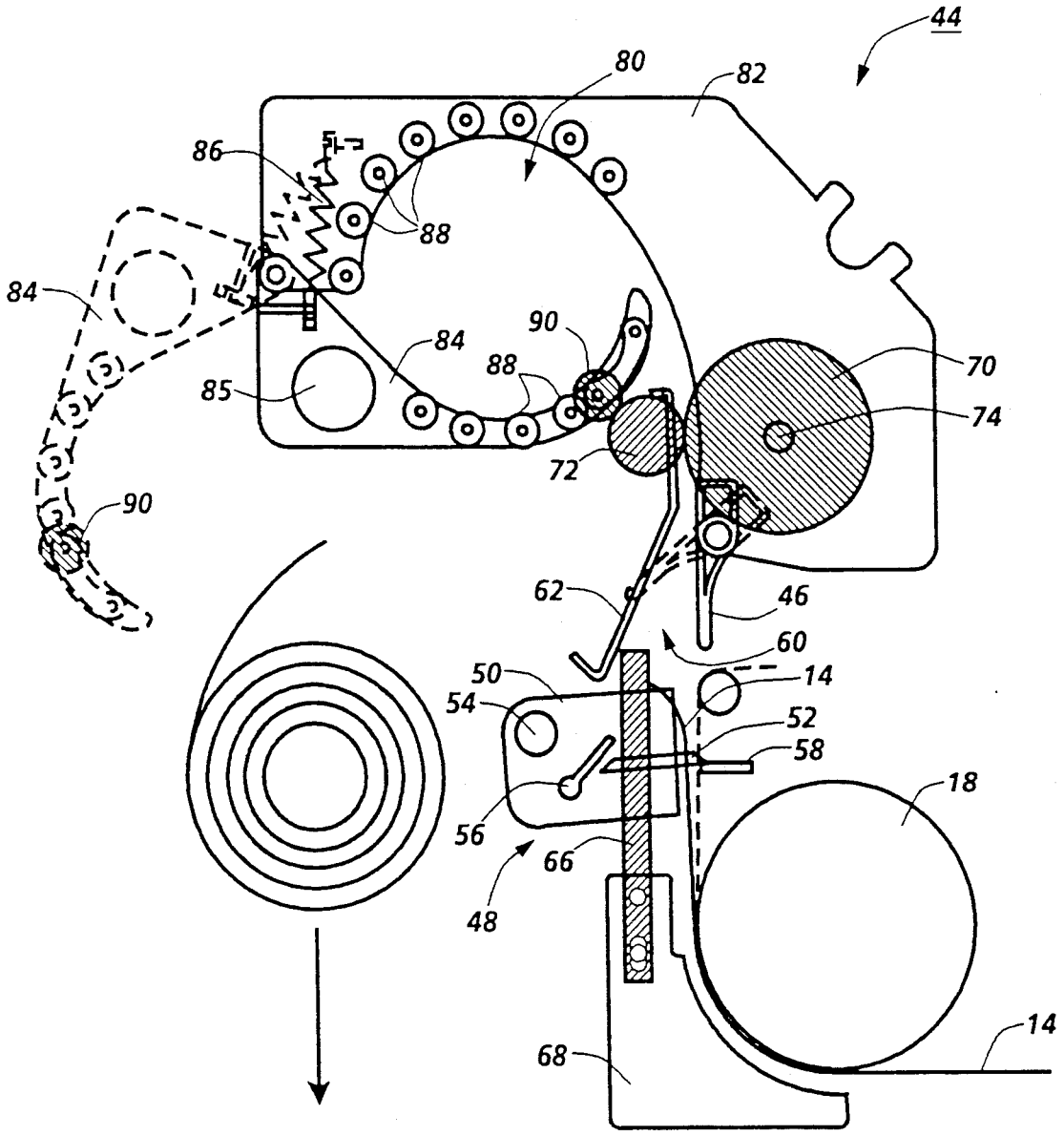
FIG. 2 is an enlarged schematic side elevation view of the spooling apparatus.
Figure 3:
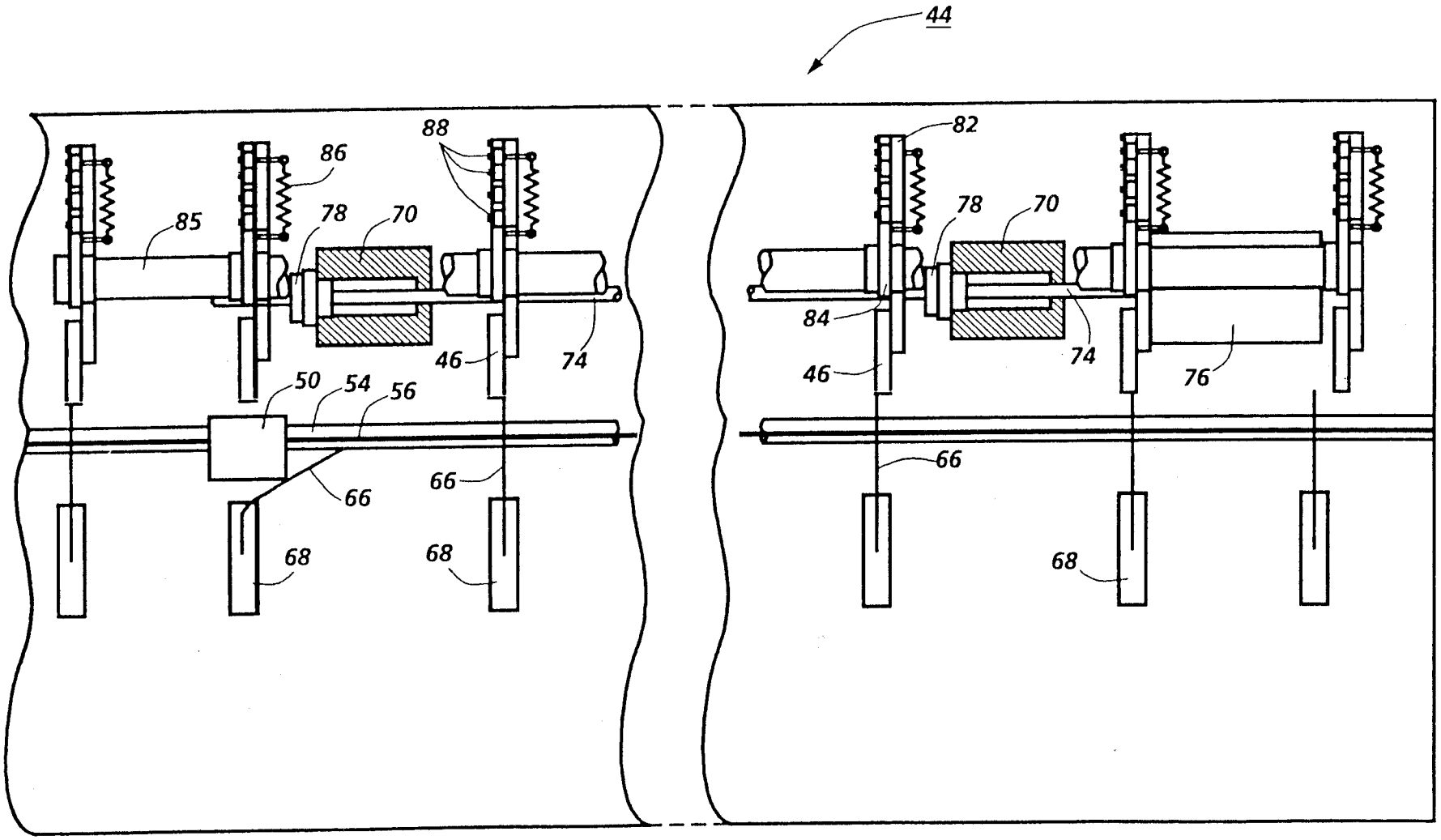
FIG. 3 is a partial schematic front elevation view showing the tugger roller mechanism of the spooling apparatus, the traversing cutter and several deflectable recording medium guide fingers.
Figure 4:
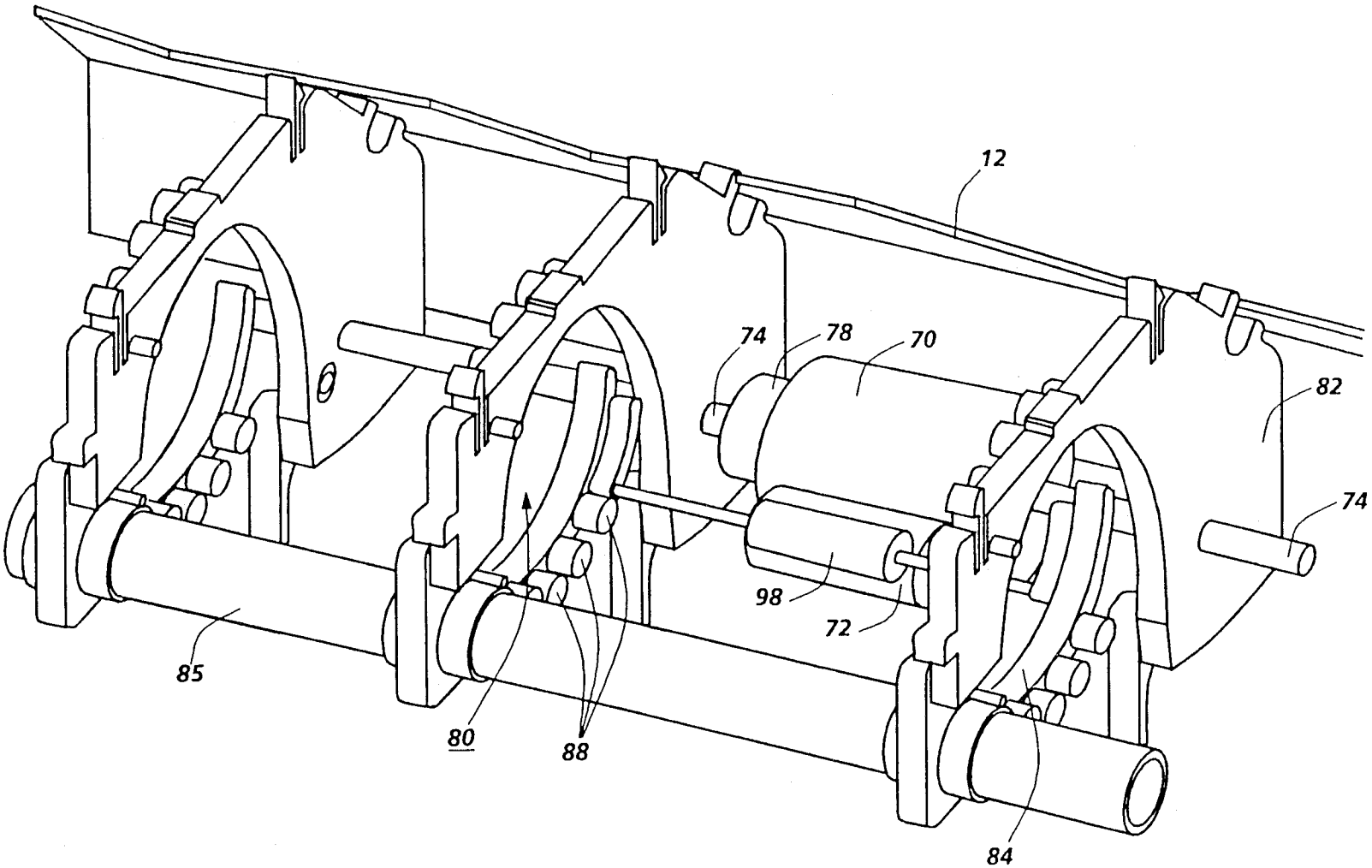
FIG. 4 is a schematic perspective view showing several baffle elements of the spooling apparatus.

The leading edge of the recording medium is driven into the entrance throat 60 of the spooling apparatus 44, comprising baffle members 62 and 46, by the drive roller 18 and will automatically thread itself therein. However, since there is a natural curl in the recording medium, which is often aggravated by high ambient humidity conditions, its leading edge has a tendency to veer away from the transport path. This presents a problem in the gap region between drive roller 18 and the entrance throat 60 (as shown) where it is not possible to place a structural media guide because of the interference movement of the cutter assembly 48. A deflectable media lead edge guide is provided, comprising a number of flexible interference fingers 66 each mounted in a support block 68. The interference fingers are made of plastic shim stock whose edge is typically about 0.010 inches thick and whose side is about 0.25 inches wide. A deflection force applied by traversing body 50 against its side (i.e. normal to the plane of the drawing in FIG. 2), may bend the finger without permanently deforming it. In its upright position (as illustrated in FIG. 2) the force applied by the leading edge of the paper 14 against its edge is insufficient to deflect the finger. Thus they will bridge the gap between the cutter wheel and the entrance throat for directing the paper but will offer very little resistance to being bent over by the bidirectionally traversing cutter assembly 48, as shown in FIG. 3.

As the lead edge of the recording medium enters the spooling apparatus it will be directed by the entrance throat guide baffles 62 and 46 into the nip between rubber surfaced tugger rollers 70 and metal pinch rollers 72. There are two sets of these rollers each acting independently upon the medium for feeding it into the spooling apparatus. Each of the tugger rollers is mounted upon a drive shaft 74 which may be driven by tugger motor 76 through a slip clutch 78 selected to break free from the motor at a predetermined amount of torque.

Beyond the tugger rollers 70, the recording medium is directed into a generally circular spooling zone 80 defined of a number of upper and lower, curved baffles plates 82 and 84. The upper curved baffle plates 82 are fixedly mounted, while the lower curved baffle plates 84 are interconnected to move as a single unit, by being secured to a guide rod 85 and are pivotally mounted below the upper baffle plates. Tension springs 86 connected between the upper and lower baffle plates urge them in the position illustrated while allowing some enlargement of the generally circular spooling zone 80 as large amounts of recording medium are introduced therein. In order to allow the recording medium to move more readily, with a lower frictional drag force, within the spooling zone 80, particularly when several feet or more thereof are loaded therein, a number of pin rollers 88 are mounted on the inner peripheral surface of each baffle plate with a portion of their outer surface extending into the spooling zone. A further feeding assist is provided by rubber surfaced assist rollers 90 straddled between two lower curved baffle plates 84 and biased against pinch rollers 72. Thus, the assist rollers are driven at the same surface speed as the tugger rollers 70 by means of the intermediate pinch rollers to positively drive the spooled recording medium within the spooling zone. As more of the medium is fed into the spooling zone and the spool gets larger the tension spring 86 will allow the lower baffle member to accommodate the somewhat larger spool diameter. It has been found that this spooling apparatus, having a nominal spooling diameter of about 2.5 inches can accommodate up to about ten feet of paper recording medium and about five feet of plastic film recording medium.

As the recording medium is fed in and out of the spooling apparatus during multi-pass color recording it is very sensitive to being skewed by the surface velocity of the tugger rollers. The key to preventing the introduction of recording medium skew or wander is to insure that the tugger rollers are always driven at the medium surface speed. This is accomplished in the present invention by means of the slip clutch drive. The tugger roller motor 76 is driven to overdrive the tugger roller shaft 74 relative to the drive roller speed. However, the intermediate slip clutch 78 is selected so that regardless of the overdrive shaft speed the tugger rollers 70 will always break free at a predetermined torque, for example, one pound of tension. This insures that each of the the tugger rollers will exert a nominal pulling force upon the recording medium as it is positively driven by the drive roller 18. For example, in the spooling direction, the drive roller may have a forward surface speed of about two inches per second and the tugger roller motor may be overdriven to yield a surface speed of three inches per second, but the slip clutch will break away so that the recording medium will be driven at two inches per second and the tugger rollers serve as tension leaders to the drive roller.

In the rewind direction, when removing recording medium from the spooling apparatus the tugger roller motor is disengaged and the drive roller pulls the medium against the resistance of the tugger rollers. The drive roller rewind speed is about ten inches per second. As the medium is pulled through the tugger rollers, the slip clutches again break free providing a fairly even tension of about one pound each.

When a plot has been completed, the cutter assembly 48 is energized to sever it from the web, its trailing edge is fed into the spooling zone 80 and finally the lower curved baffle plates 84 are pivoted by a suitable linkage mechanism (not shown) into the spool dropping position illustrated in dotted lines. The spooling apparatus is then ready to accept the next plot.

The spooled plot falls into a uniquely configured catch tray 92 which serves to maintain and enhance the tight tubular form of the recording medium. As the nominal 2.5 inch diameter spool drops from the spooling apparatus the unconstrained last wraps thereon have a tendency to loosen. The catch tray comprises a generally U-shaped wire form basket which is made of a wire stock sufficiently thick to be rigid but thin enough to impart some springiness to its walls. A wire diameter of about 0.187 inches has been found to be satisfactory. The catch tray is hung upon the plotter housing 12, directly below the spooler apparatus 44 and generally centrrally located thereunder, by means of bent hanger portions 94. One wire wall 96 of the basket lies adjacent to the housing and its opposite wall 98 includes a lower, parallel portion 100 and an upper, outwardly flared portion 102. The upper portion serves as a throat to receive the tubular plot as it falls and to direct it into the nominally 2.4 inch wide lower portion. Under ordinary circumstances it would be difficult for the tubular plot to drop to the bottom of the catcher tray because of the interference fit. However, the walls 96 and 98 are provided with different surface coefficients of friction so that the tubular plot is caused to roll down the tray. For example, by vinyl coating or roughening wall 96 and by metal plating (e.g. nickel) or highly polishing wall 98 it is possible to cause the outer surface of the tubular plot to slide along wall 98 and to roll along wall 98. This rolling action causes the tubular plot to be maintained in a tight roll.

It should be understood that the present disclosure has been made only by way of example and that numerous changes in details of construction and the combination and arrangement of parts mmay be resorted to without departing fromm the true spirit and scope of the invention as hereinafter claimed.

What is claimed is:

1. Apparatus for automatically spooling output media from a printer comprising means for supplying a recording medium having a leading end, means for forming said recording medium into a tubular form such that said leading end directs said recording medium into said tubular form in the absence of an internal supporting member, means for bidirectionally driving said recording medium into and out of said means for forming, and means for applying a tensioning force on said recording medium at a location between said means for forming and said means for driving, said means for applying a tensioning force comprises a roller having a friction applying surface, an idling pinch roller biased thereagainst, a shaft upon which said roller is mounted, a slip clutch having a preselected slipping torque interposed between said shaft and said roller, and drive means for rotating said shaft, said tensioning force being of substantially the same magnitude when said recording medium is being driven into said means for forming as when said recording medium is being driven out of said means for forming, and wherein the surface speed of said recording medium is determined by said means for bidirectionally driving.

2. The apparatus for automatically spooling output media from a printer as defined in claim 1 wherein said tensioning force is achieved, as said recording medium is being driven into said means for forming, when said roller is overdriven by said shaft, relative to said means for bidirectionally driving, so that said slip clutch slips and the surface speed of said roller is the same as the surface speed of said means for bidirectionally driving.

3. The apparatus for automatically spooling output media from a printer as defined in claim 1 wherein said tensioning force is achieved, as said recording medium is being driven out of said means for forming, when said roller is not being driven by said shaft, so that said slip clutch slips and the surface speed of said roller is the same as the surface speed of said means for bidirectionally driving.

4. The apparatus for automatically spooling output media from a printer as defined in claim 1 wherein said means for forming comprises a plurality of aligned baffles defining a tubular opening of generally circular cross-section and means thereonfor assisting the movement of said recording medium within said tubular opening, the surface speed of said means for assisting is the same as the surface speed of said means for bidirectionally driving.

5. The apparatus for automatically spooling output media from a printer as defined in claim 4 wherein said means for assisting is biased against and is driven by said idling pinch roller.

6. The apparatus for automatically spooling output media from a printer as defined in claim 4 further including a plurality of idler rollers mounted upon said baffles, each idler roller having an arcuate portion extending into said generally circular opening for allowing said recording medium to roll thereon.

* * * * *